US005315471A

United States Patent [19]

Hurley et al.

[11] Patent Number: 5,315,471

[45] Date of Patent: May 24, 1994

[54] COIL CURRENT REGULATOR WITH INDUCED FLUX COMPENSATION IN AN ELECTROMAGNETIC CONTACTOR SYSTEM

[75] Inventors: Rick A. Hurley, Fletcher; Mark E. Innes, Asheville, both of N.C.

[73] Assignee: Westinghouse Electric Corp., Pittsburgh, Pa.

[21] Appl. No.: 891,877

[22] Filed: Jun. 1, 1992

[51] Int. Cl.[5] ..... H01H 67/02

[52] U.S. Cl. ..... 361/160; 335/131; 335/132; 335/231; 361/154; 361/187

[58] Field of Search ..... 361/154, 187, 153, 152, 361/155, 156, 159, 160, 194; 335/231, 233, 131, 132, 170

[56] References Cited

U.S. PATENT DOCUMENTS 4,893,102 1/1990 Bauer ..... 335/132

*Primary Examiner*—A. D. Pellinen
*Assistant Examiner*—Aditya Krishnan
*Attorney, Agent, or Firm*—M. J. Moran

[57] ABSTRACT

The coil holding current of a contactor is regulated to the lesser of two measurements of coil current during each cycle of the full-wave rectified control voltage to compensate for induced flux in the coil generated by load current through the main contacts of the contactor, thereby preventing uncontrolled drop out of the contactor.

18 Claims, 11 Drawing Sheets

COIL CURRENT REGULATOR WITH INDUCED FLUX COMPENSATION IN AN ELECTROMAGNETIC CONTACTOR SYSTEM

CROSS-REFERENCE TO RELATED APPLICATION

Commonly owned U.S. application Ser. No. 07/636,000, filed Dec. 28, 1990, whose inventors are J. C. Engel et al. and entitled "A Process For Auto Calibration Of A Microprocessor Based Overcurrent Protective Device and Apparatus."

BACKGROUND INVENTION

1. Field of the Invention

This invention relates to the field of electromagnetic contactors and more specifically to a method of minimizing the magnitude of current flowing in the coil of an electromagnetic contactor yet maintaining sufficient coil current to ensure positive holding even in the presence of induced flux effects.

2. Background Information

Electromagnetic contactors are used for controlling large amounts of electrical power supplied to electrical motors having operating currents in the range of a thousand or more amperes. Electromagnetic contactors may be configured as simple switches or as motor starters having integral current sensors and overload control circuits. In its simplest form, an electromagnetic contactor is a high-current switch having bridging contacts which are actuated with a spring-biased solenoid. The bridging contacts are typically configured with a fixed contact and a movable contact coupled to the spring-biased solenoid. The spring biasing of the contactor mechanism utilizes a kickout spring and a contact spring. The kickout spring maintains the bridging contacts in a normally open position. To close the contacts, current is injected into the contactor coil to actuate the solenoid mechanism and to move the bridging contacts to a closed position. Before the bridging contacts can move between the open and closed positions, the solenoid must generate enough force to overcome the force exerted by the kickout biasing spring. The moveable contacts then accelerate toward the fixed contacts until the contacts touch. The force applied to the contacts in the closed position is controlled by the contact spring and current flowing in the contactor coil which in turn controls the solenoid actuator. Once the contacts are touching, the current in the contactor coil is maintained at a level sufficient to maintain the bridging contacts in the closed position. The current flow in the coil is then interrupted to return the contactor to the open, rest position.

In the past, electromagnetic contactors were constructed as open systems, wherein the currents delivered to the contactor coil were in ranges calculated to provide acceptable performance. Most often, the currents used to drive the contactor coil were far in excess of the actual current required to provide an operating margin thought to anticipate all worst-case operating conditions. This type of contactor design results in several problems. Since excess current levels are used, the contactor operates in an inefficient mode, resulting in wasted energy and excess heat. Furthermore, since large currents are delivered to the contactor coil when accelerating the contactor contacts to a closed position, the contacts often accelerate to a high speed, resulting in contact bounce when the contacts ultimately close.

One system designed to overcome these problems is disclosed in U.S. Pat. No. 4,893,102, incorporated herein by reference. This system provides a bounceless contact closing operation by sensing the amount of current flowing in the contactor coil on a half-cycle basis. Specifically, the contactor coil voltage is sensed by a contactor control system and compared against a memory menu of stored delay angles. The delay angles are applied to the conduction interval of a gating device which is coupled in series with the contactor coil to control the current flowing therethrough. Depending upon the voltage sensed, the current flowing through the coil is varied on a half-cycle basis by the control system. The energy supplied to the closing contacts is such that only sufficient energy is imparted to allow the contacts to move to the closed position with a decreasing velocity which approaches zero as the contacts come into contact with each other. Once the contacts are closed, the coil current is regulated at a predetermined holding level by varying the conduction angle of the gating device coupled to the contactor coil.

While this system provides a vast improvement over contactor systems used in the past, it is susceptible to certain failure modes in multi-phase systems. Specifically, it is known that the large currents flowing in the contacts may induce unwanted flux in the contactor coil. In a multi-phase contactor system, depending on coil orientation relative to the contacts, and the direction of the current flowing in the respective contacts, the induced flux can result in the partial cancellation of currents flowing in the contactor coil. This reduction in net holding current may result in unwanted contact "drop-out" even when the applied coil holding current is well above the calculated current range for providing stable contactor operation.

From the foregoing, no system is known which provides all of the advantages of the system of U.S. Pat. No. 4,893,182, while also eliminating contact "drop-out" due to unwanted induced flux effects.

SUMMARY AND OBJECTS OF THE INVENTION

Briefly described, the present invention contemplates an electrical contactor and a method of operating an electrical contactor which compensates for flux induced in the contactor coil by load current flowing through the closed contactor. The use of the term electrical contactor here is intended to embrace devices commonly known as contactors, motor starters, load controllers, and related switching devices in the broad sense.

In the present invention, a regulator gates time delayed pulses of full wave rectified ac voltage to the coil of the contactor. Thus, the control voltage applied to the contactor coil is dc, so that the coil current and the resulting flux is dc. However, the induced flux produced by the load current flowing through the contactor contacts is ac, and will alternately add to or buck the dc flux produced by the control voltage. In accordance with the invention, coil current is read at two spaced apart instants during a cycle of the control voltage, and the smaller measurement is used to regulate coil current to make sure that the minimum coil holding current is maintained.

Where coil current can be measured during the positive and negative half cycles of the control voltage, the two measurements of coil voltage are taken at corresponding instants during application of the positive and negative rectified pulses of the control voltage. As the two readings are taken at substantially the same instants during the positive and negative half cycles of the control voltage, so that they are substantially 180 electrical degrees apart, they will be substantially equal under steady state conditions without any induced flux.

Where the indication of coil current is derived from a measurement of ac current which is then rectified to power the coil, and the regulator can only read positive currents, the invention calls for delaying turn off of the switch controlling gating of the rectified negative half cycle pulses of the coil beyond the zero crossing into the beginning of the positive half cycle, and after a short delay, taking a reading of the current. Since in this case the two readings are not taken 180 electrical degrees apart, an offset is applied to the second reading to compensate for the phase difference. The offset is the amount which makes the magnitude of the second measurement with the offset added to it equal to the magnitude of the first measurement under steady state conditions without load current flowing through the main contacts of the contactor. This offset can be established empirically by selecting a large initial value for the offset, and regulating coil current under steady state conditions without load current flowing through the contacts of the contactor. The value of the offset, is then successively reduced. Initially, the first reading will be smaller than the second reading plus the very large offset, so that no change in regulation will be noticed as the offset is reduced. When a change in regulation is noted, the offset has been reduced to the desired value, which is then stored and used for regulation.

Accordingly, it is an object of the present invention to provide a contactor system which maintains stable operation even in the presence of induced flux.

It is another object of the present invention to provide a bounceless contactor system which optimizes current holding pulses when an electromagnetic contactor is in a closed position.

It is still another object of the present invention to provide a system which eliminates contactor failure modes which are caused by induced flux effects, while requiring only minimum modifications to existing systems.

BRIEF DESCRIPTION OF THE DRAWINGS

These and other objects will be apparent to persons of ordinary skill through the detailed description of the invention below and the accompanying drawings in which.

DESCRIPTION OF THE PREFERRED EMBODIMENTS

Figure 1:
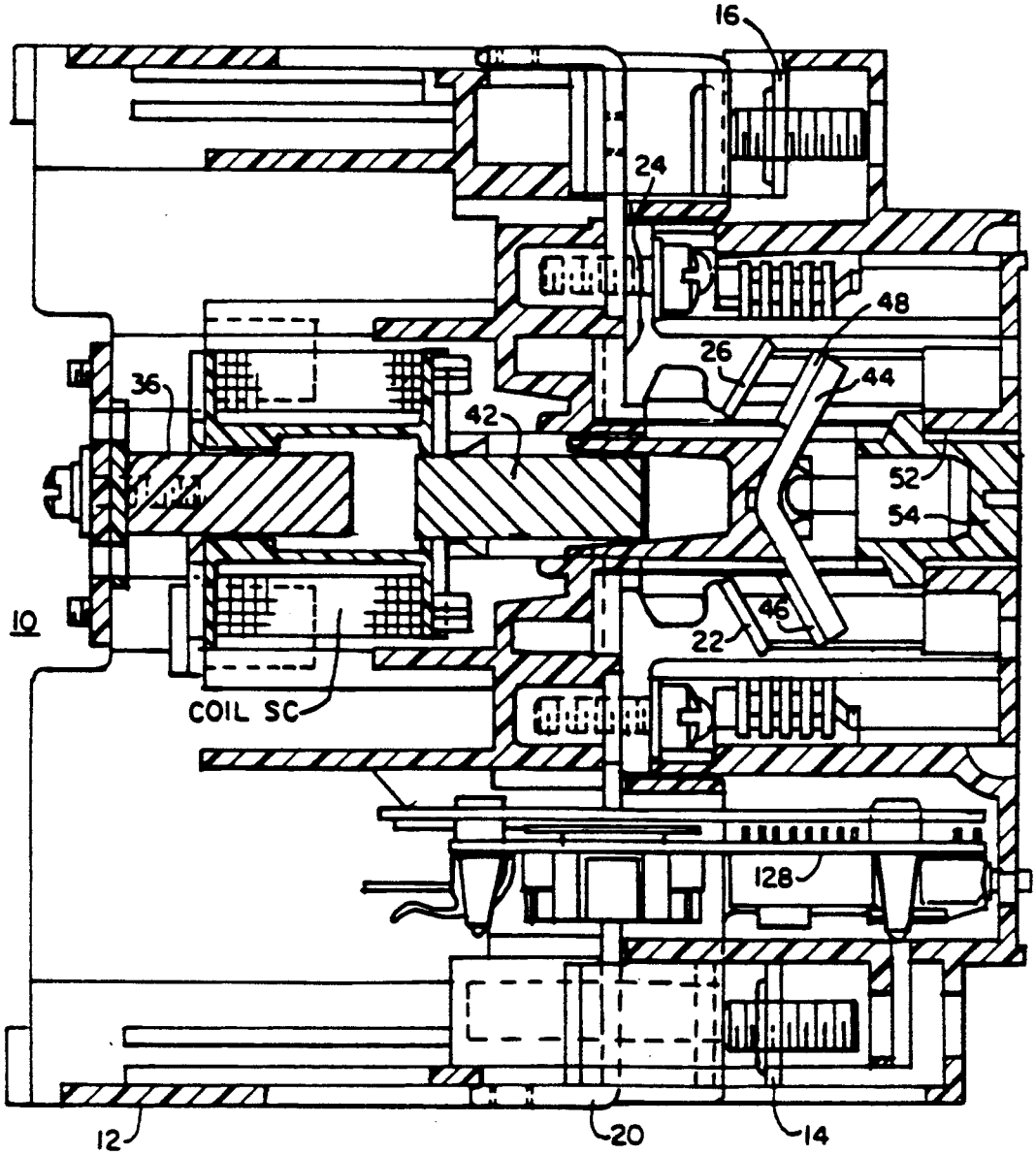
FIG. 1 is a diagram showing the spatial relationship of contactor coils and contracts in a typical three-phase contactor system.

A complete description of a load controller such as a motor starter to which the present invention is applied is provided in the above identified related application which is hereby incorporated by reference. The same reference characters will be used in this application to identify elements common with those in the related application.

Referring to FIG. 1, the motor starter 10 has an insulated housing 12. A pair of spaced apart terminals 14, 16 for each phase (only one phase shown) are provided for connecting an electrical load, such as a motor winding which is to be controlled by the motor starter device 10, to a power source. Terminal 14 is interconnected with an internal conductor 20 leading to a fixed contact 22 while terminal 16 is interconnected with an internal conductor 24 connected to a fixed contact 26. A contact carrier 42 supports an electrically conductive contact bridge 44 having movable contacts 46, 48 at opposite ends which are complimentary with the fixed contacts 22, 26, respectively.

Movement of the contact carrier 42 and therefore the contact bridge and moveable contacts 46, 48 is effected by a magnet 36 having a coil SC. The coil SC is in turn controlled by a circuit board 128 to be described in detail below. The carrier 42 is spring biased to the position shown in FIG. 1 in which the contact pairs 22, 46 and 26, 48 are opened to interrupt the circuit between terminals 14 and 16. When the coil SC is energized, the carrier 42 is pulled down against the magnet 36 to close the contact pairs 22, 46 and 26, 48 thus completing a circuit to energize the load, such as a motor winding connected to the motor starter 10.

Figure 2A:
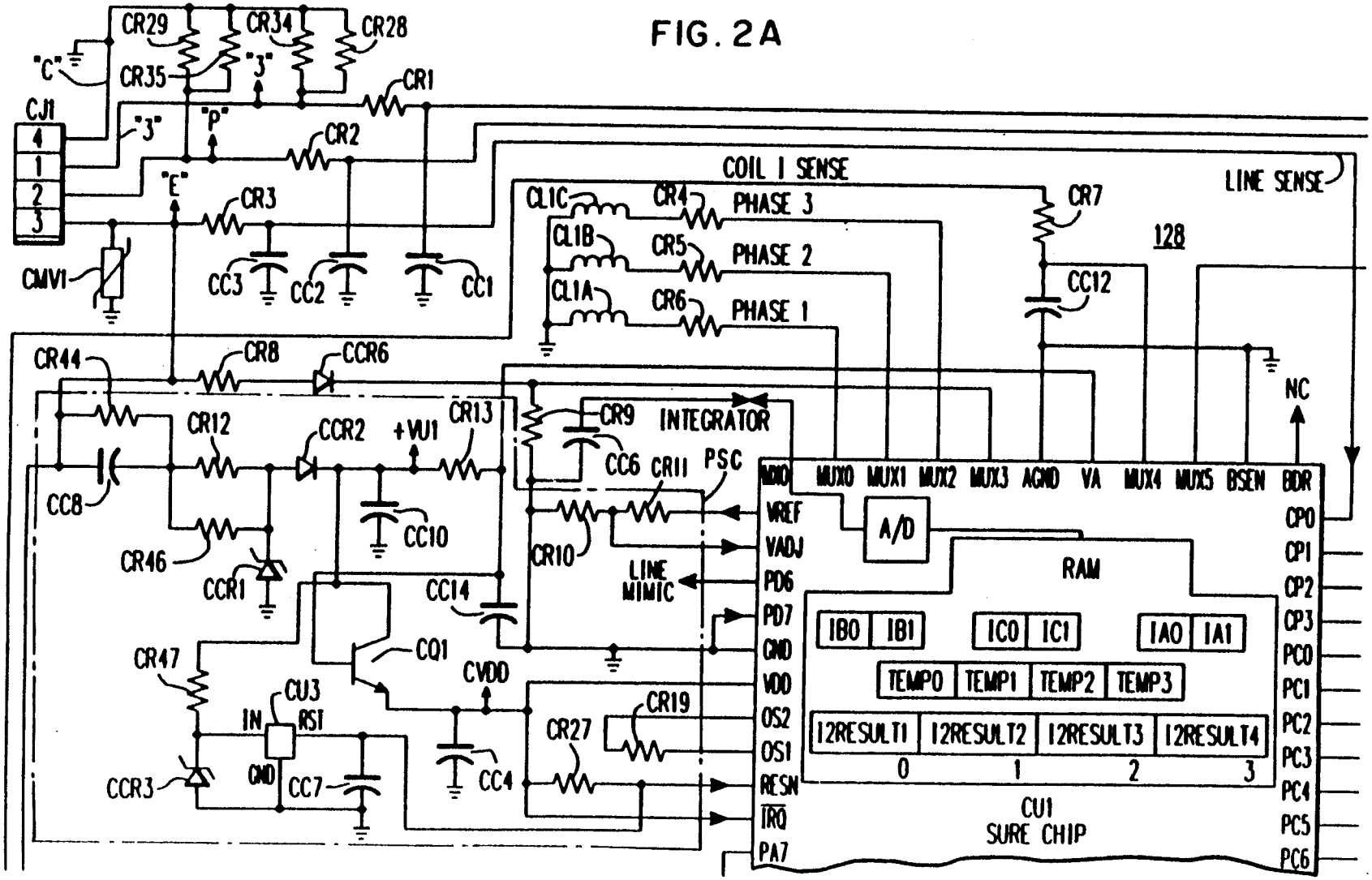
FIGS. 2A-2C illustrate a block diagram of the control system used to control the contactor coils of the system of the present invention.
Figure 2B:
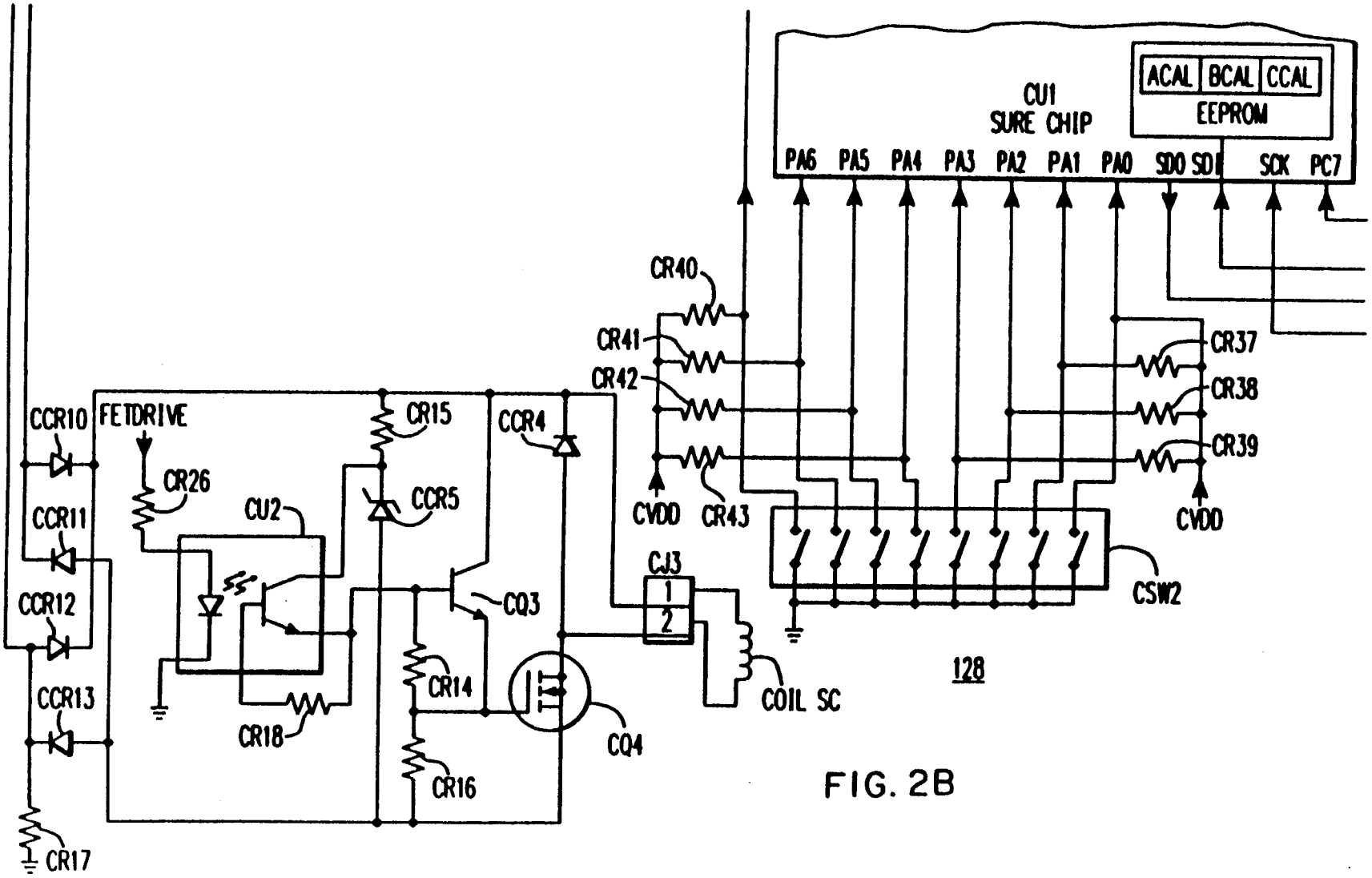
Figure 2C:
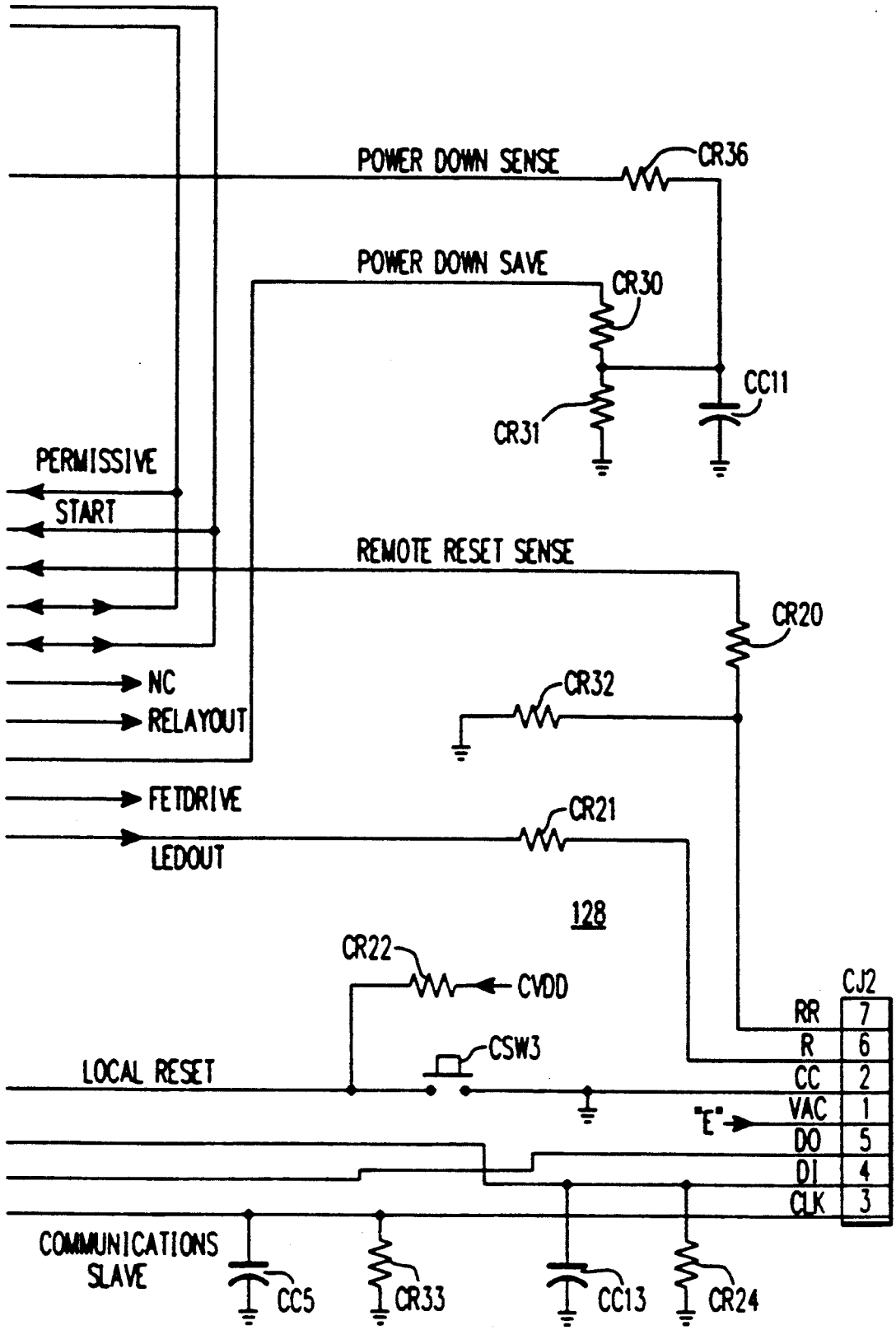

FIGS. 2A-2C together illustrate a schematic circuit diagram for the control board 128 which controls operation of the motor starter coil SC. The heart of the control circuit 128 is a microprocessor provided on the integrated circuit chip CU1. A suitable microprocessor chip CU1 is the "sure chip" which is disclosed in more detail in the above cross-referenced application. The chip CU1 includes a multiplexer, in addition to the processor, memory, and analog and digital input and output interfaces.

Returning to FIG. 2A, four inputs labeled 1-4, are provided on an input connector CJ1. Terminal 4 is connected to system common or ground and is designated the "C" input. Terminal 1 of the connector CJ1 inputs a start signal which is identified as "3" and is applied to the chip CU1 to start the motor. Terminal 2 of the connector CJ1 provides a permit signal "P" which must be present in order for the motor to run. Terminal 3 of the connector CJ1 receives the 120 volt line voltage which is designated as the signal "E". This line voltage signal "E" provides power for operation of the microprocessor CU1 and for energization of the contactor coil SC, as well as providing a timing signal for the microprocessor to gate portions of the line current to the contactor coil SC. The signals "3", "P", and "E", are passed through low pass filters formed by the resistors CR1-CR3 and capacitors CC1-CC3 before being applied to the chip CU1. A varistor CMV1 protects the circuit from surges in the line voltage.

A power supply circuit PSC fed by the line voltage signal "E" provides regulated voltages for the chip CU1. Current transformers CL1A, CL1B and CL1C monitor the three-phase load current for input to the chip CU1 through multiplexer inputs MUX0–MUX2. The system voltage as represented by the "E" signal is input through multiplexer input MUX3.

The ac line signal "E" is rectified by the bridge circuit formed by the diodes CCR10–CCR13 to generate dc current for energizing the contactor coil SC. Energization of the coil SC by the dc current is controlled by a FET, CQ4. The FET CQ4 in turn is controlled by a FETDRIVE signal generated by the chip CU1. The FETDRIVE signal is isolated from the power circuit by an opto-isolator chip CU2. A transistor CQ3 forms with the photo diode of the optoisolator CU2, a Darlington circuit which controls turn-on of the FET CQ4. The FETDRIVE signal is a pulse signal synchronized by the chip CU1 to the cycles of the line current to input the required amount of energy to close the contactor, and at a reduced level of energization to maintain the contactor closed. A measure of the coil current, detected as the voltage across resistor CR17, is fed back to the chip CU1 as the "COIL I SENSE" signal which is applied to the MUX4 multiplexer input of the chip CU1 through a low pass filter formed by the resistor CR7 and capacitor CC12.

The motor starter 10 provides overload protection for the motor connected to the starter. A set of dip switches CSW2 provides for selection of the rated current for the motor being controlled through the inputs PA1–PA6 of the chip CU1. The dip switches also provide for selection of two trip delays through inputs PA0 and PA7.

Turning to FIG. 2C, an external capacitor CC11 stores a motor heat profile characteristic value generated by the chip CU1. This value is applied to the capacitor CC11 through the port PC4 and resistor CR30. The value of the heat profile characteristic stored in the capacitor CC11 decays by discharge through a resistor CR31 at a rate which mimics the cooling of a motor controlled by the starter 10 when power has been removed from the circuit board 128.

The charge stored on the capacitor CC11 is read by the chip CU1 through the multiplexer input MUX5 which is connected to the capacitor CC11 through the resistor CR36.

The starter 10 can be reset remotely by a signal received through a connector CJ2 and applied to the chip CU1 as a REMOTE RESET SENSE signal. The chip CU1 also generates a LEDOUT signal through the connector CJ2 for energization of an LED on a remote console for indicating the operating mode of the starter. The starter 10 can also be reset locally by activation of the switch CSW3. The microprocessor based motor starter can communicate with, and be controlled by, a remote station through a serial data input port SDI and a serial data output port SDO synchronized by a clock signal which is input through port SCK. The remote clock signal and the serial data input and output signals are connected to the remote system through terminals on the connector CJ2.

The microprocessor incorporated into the Sure Chip CU1 regulates the pulsed dc current applied to the contactor coil SC through the FETDRIVE signal which controls the FET CQ4. As described in U.S. Pat. No. 4,893,103, the sure chip turns on the FET CQ4 at instants calculated to provide sufficient flux to the coil SC to just bring the contacts 22, 46 and 26, 48 to the closed position without contact bounce. Once the contacts have closed, the FETDRIVE signal is further delayed to phase back the pulses of rectified ac voltage applied to the coil SC. It is desirable to reduce the holding current which maintains the contacts in the closed position as low as possible to reduce energy consumption and heating of the coil SC.

Figure 3A:
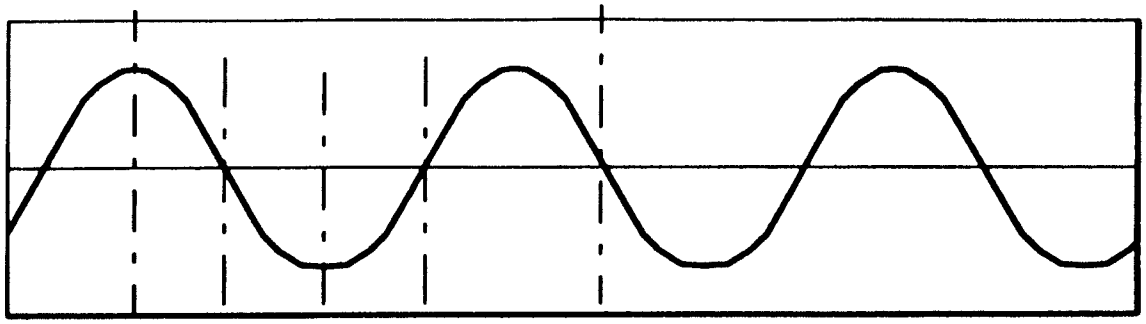
FIGS. 3A-3C are wave forms illustrating operation of the contactor of FIGS. 1 and 2A-2C in accordance with the invention.
Figure 3B:
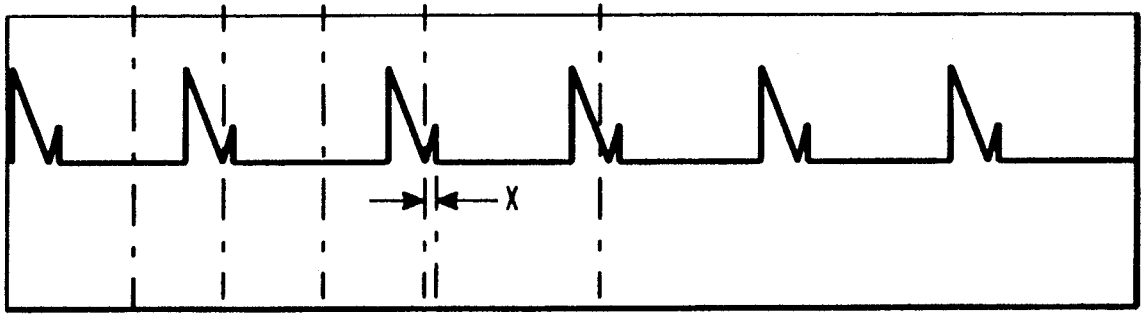

FIG. 3A illustrates the waveform of the voltage of the signal "E" which is rectified and applied to the coil SC as the control voltage. FIG. 3B illustrates the pulsed full wave rectified voltage applied to the coil SC in the holding mode. As can be seen from FIG. 3B, gating of the FET CQ4 is delayed so that only a small part of the last portion of the voltage pulses are applied to the coil SC under these conditions.

Figure 3C:
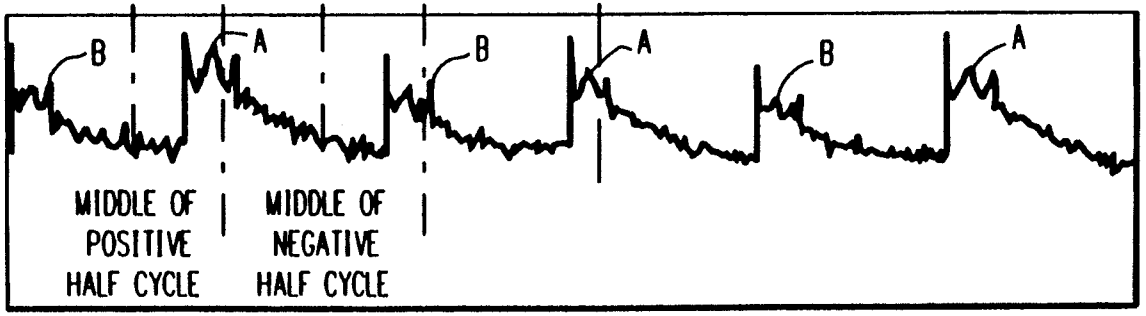

The current generated in the coil SC by the voltage pulses is shown in FIG. 3C. Due to the inductance of the coil SC, current continues to flow in the coil through the flyback diode CCR4 when the FET is turned off. Under steady state conditions with the holding current regulated to a selected value the magnitude of the current reached during the alternate positive and negative half cycles of the control voltage would be the same. However, with high three-phase currents passing through the contacts 22, 46 and 26, 48 of the contactor, an additional flux is induced in the magnet. The magnitude of this induced flux depends upon the magnitude of the three-phase current, the distance between the magnet and the three phase conductors, and the orientation of the magnet relative to the three phase conductors. The induced flux produced is an ac flux that has a frequency equal to that of three-phase conductors. Therefore, the total flux in the magnet is the addition of the flux produced by the pulsed dc voltage and the flux produced by the high three-phase current. If the magnitude of the three-phase load current produced flux is sufficient, then a premature drop out of the contactor will occur due to the three-phase induced flux bucking the flux produced by the pulsed dc voltage. Since the coil driver flux is dc and the three-phased induced flux produced by the load current is ac, the two fluxes buck on one half cycle of the induced flux and add in the other half cycle of the induced flux. It is particularly critical that a contactor be able to hold in at fifteen times rated current for one second. If the induced current produced by this over current through the main contacts is sufficient on alternate half cycles to cause the coil current to drop below the minimum holding current, the contactor will not be able to meet this performance standard.

As mentioned previously, the coil controller board utilizes coil current as feedback which is used by the Sure Chip CU1 to perform the coil current regulation function. Normally the coil current is regulated to a target so that consecutive readings are treated equally. Hence, if one reading is over the target or set point value, the regulator will increase the delay of the next pulse, and if the coil current reading is below the target, the regulator will decrease the delay of the next pulse of the rectified voltage. If readings of coil current are taken once every half cycle, the effect on the regulator reading caused by the induced flux will be one high reading due to the normal holding flux and the induced flux adding, and one low next reading due to the normal holding flux and the induced flux bucking (subtracting). The net effect is that the current regulator is regulating at an average of the two readings with no regard for the fact that the minimum flux (current) must be maintained in order for the contactor to remain closed. When the magnitude of the induced flux is high enough, the contactor will drop out. If regulator current is read only once each cycle, then, depending on the phasing of the induced flux, the coil current readings will either be all high or all low. In the case where they are all low, the regulator will be compensating for the induced flux and will have better ability to hold at a higher induced flux level. However, there is no way to guarantee the phasing of the induced flux to the current coil readings.

Accordingly, in accordance with the invention, two readings spaced apart in time are taken during each cycle of the control voltage, and the Sure Chip CU1 regulates holding current to the lowest of the two readings. With this solution, the induced flux can be of any phasing relative to the coil current readings, and the current regulator will compensate for the induced flux by holding the lowest reading to the target value.

In the exemplary contactor as described herein, and in U.S. Pat. No. 4,893,102, current feedback representative of the current in the coil SC is derived from the ac current delivered to the full wave bridge measured by the voltage across the resistor CR17. While current flows continuously in the coil SC, ac current only flows through the resistor CR17 when the FET CQ4 is turned on. It is desirable to make the two coil current measurements 180 electrical degrees apart so that they can be compared directly. Ideally this would be accomplished by taking measurements at the same phase angle during the positive and negative pulses of the control voltage gated to the coil. However, in the exemplary system, the Sure Chip can only read positive feedback voltages. To accommodate for this, the FET CQ4 is not turned off at the zero crossing of the rectified negative pulse of control voltage, but is left on into the beginning of the following positive half cycle as indicated at X in FIG. 3B. A first current reading is then taken during each positive half cycle pulse such as points A in FIG. 3C and the second reading is taken in the overlap at the beginning of each positive half cycle while the FET remains on following a negative half cycle as indicated at points B in FIG. 3C. Thus, while the two readings for each cycle are not fully 180 electrical degrees apart, they are sufficiently spaced in time to be able to detect the effects of induced flux.

As the two measurements of coil current are not taken at the same instant during the positive and negative half cycles of the control voltage, an offset must be applied to compensate for this phase difference. This offset, which in the exemplary embodiment of the invention is added to the coil current measurement at the beginning of the positive half cycle, makes the two readings equal under steady state conditions of the holding current and without any induced flux. This offset is set by applying holding current to the coil SC and establishing steady state conditions without any load current passing through the main poles of the contactor so that there is no induced flux. A large initial value is selected for the offset so that the sum of the offset and the second measurement of current during the beginning of a positive half cycle exceeds the steady state magnitude of the coil current taken by the first measurement during the positive voltage pulse. Under these conditions, the regulator will regulate to the first reading taken during the positive voltage pulses, as this is the lower of the two measurements. The offset value is then reduced while the coil current to which the regulator is regulating is monitored. When the monitored coil current begins to decrease, the sum of the second reading of coil current plus the offset value becomes less than the first measurement during the positive voltage pulse. Hence, the offset is set at the point at which the monitored voltage just begins to decrease.

Figure 4A:
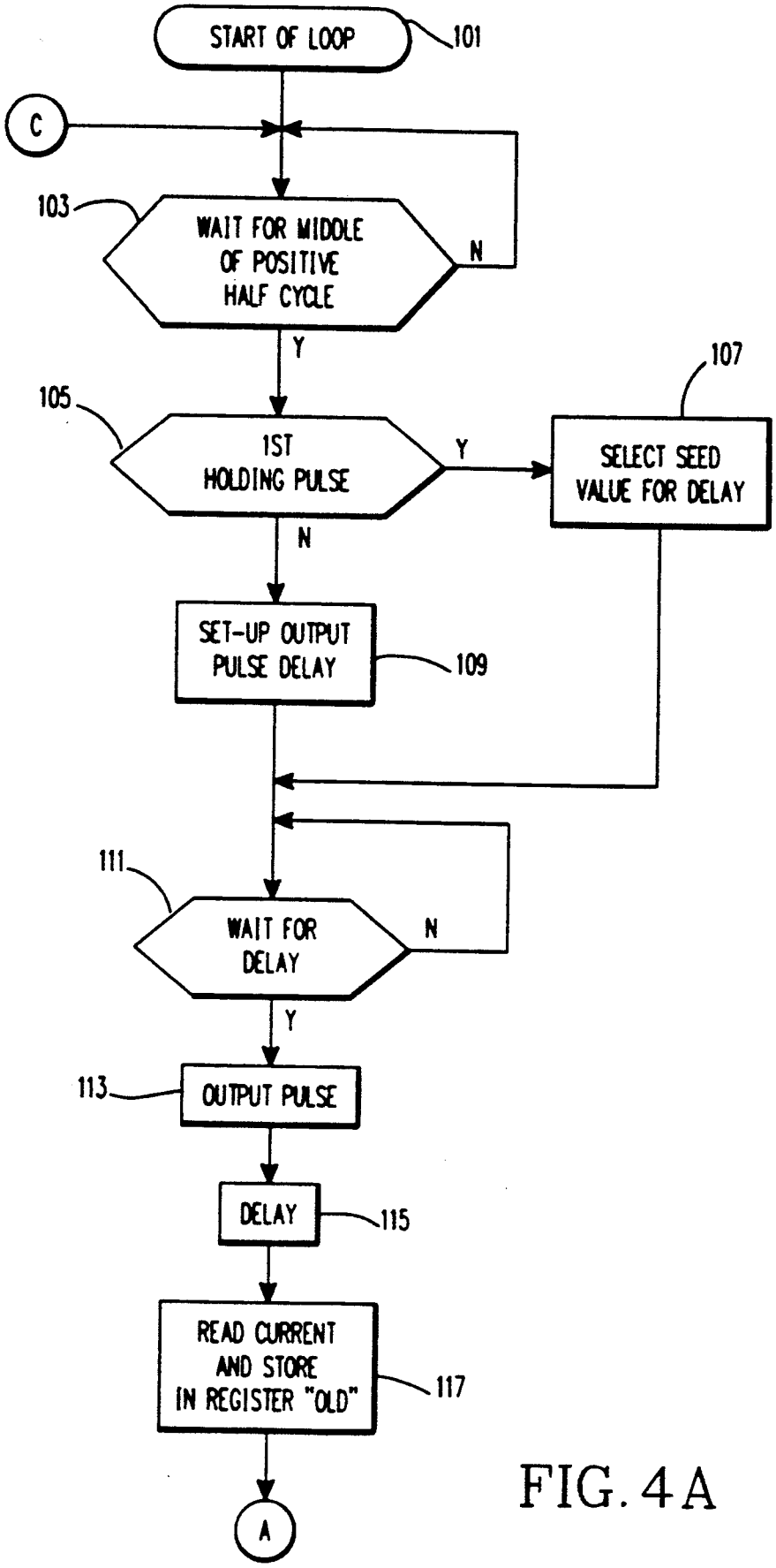
FIGS. 4A-4C are flow charts of a suitable program for operating a microprocessor which forms part of the regulator shown in FIGS. 2A-2C in accordance with the invention.
Figure 4B:
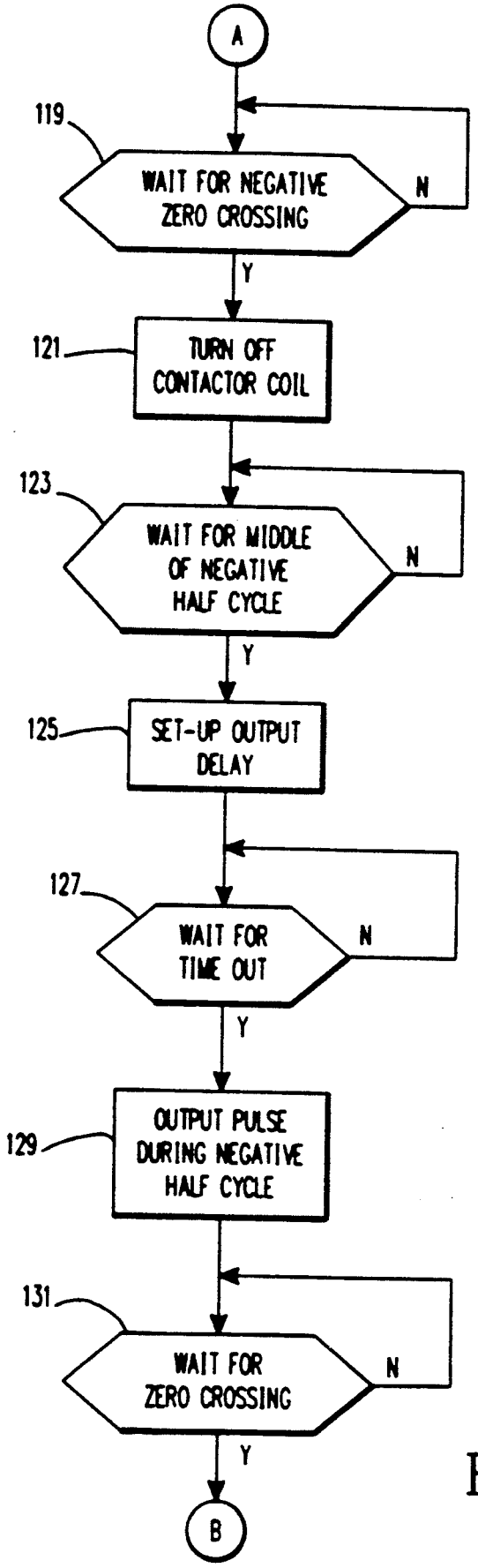
Figure 4C:
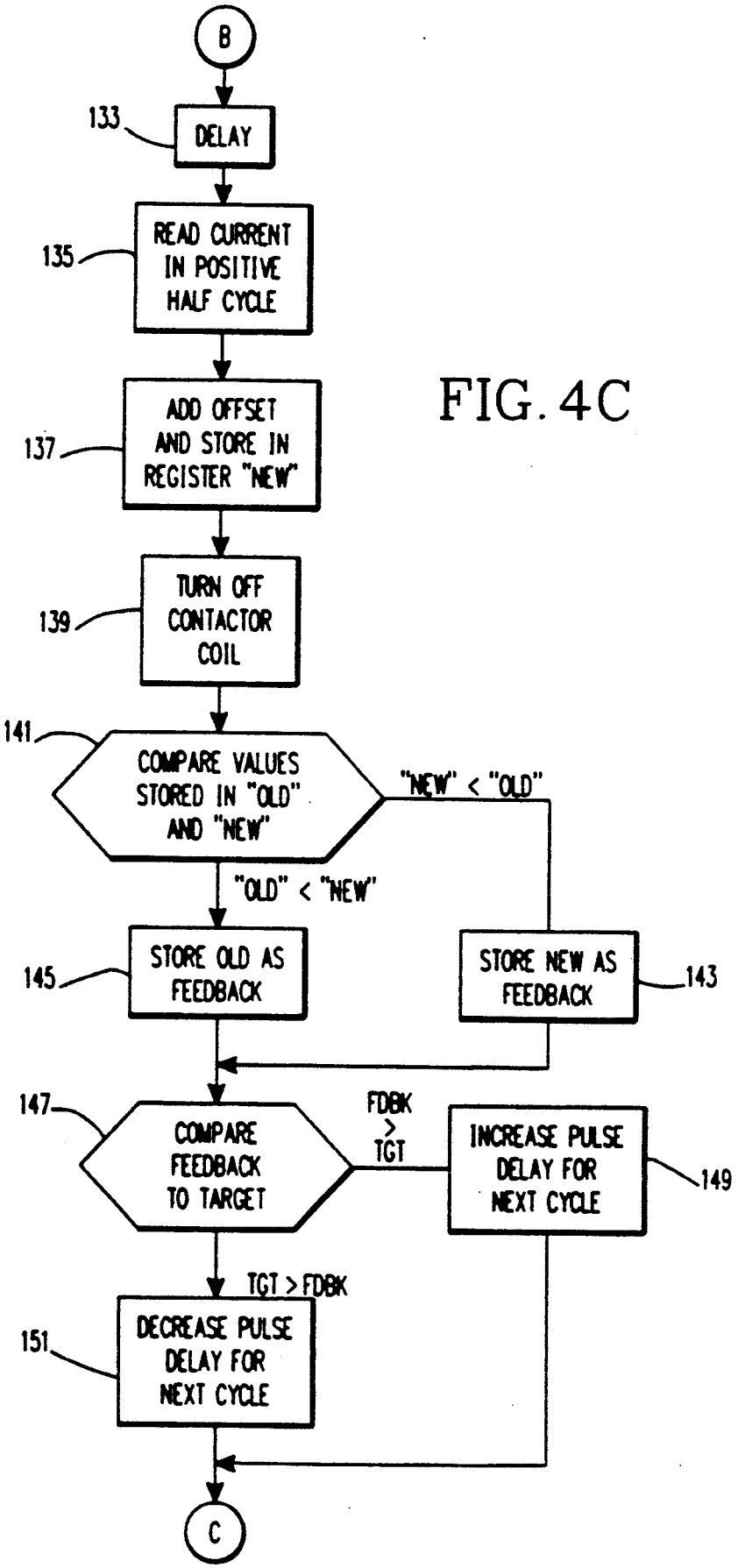
Figure 5A:
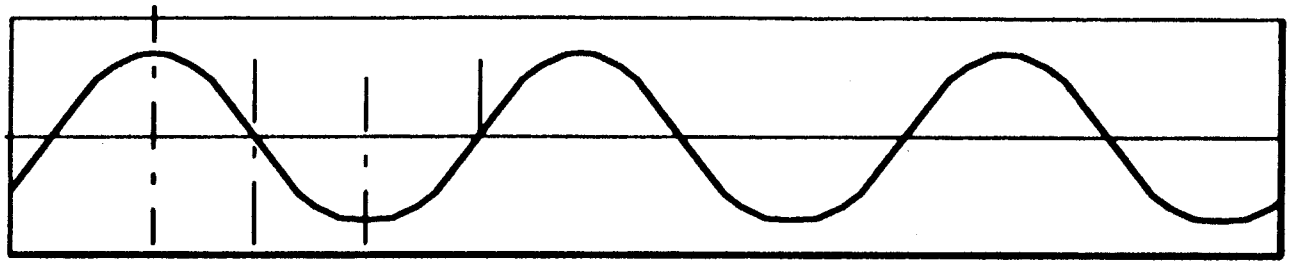
FIGS. 5A-5C are wave forms illustrating operation of the contactor of FIGS. 1 and 2A-2C in accordance with another embodiment of the invention.
Figure 5B:
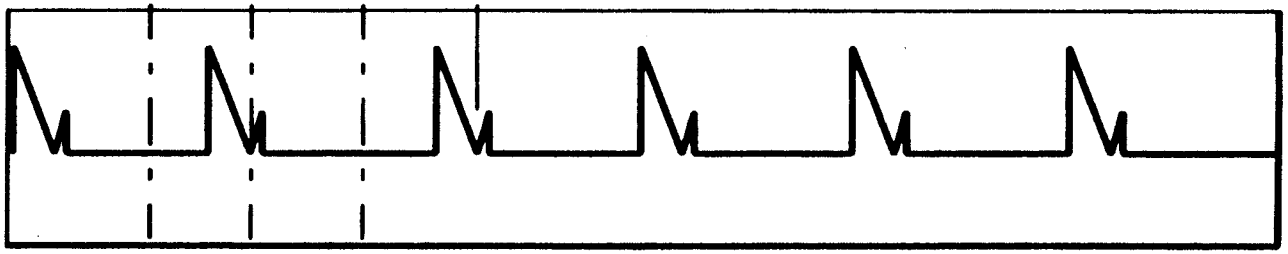
Figure 5C:
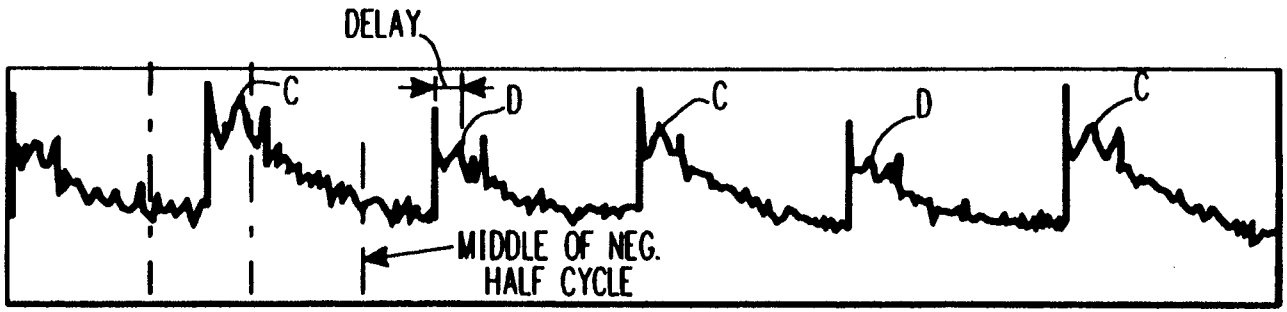

FIGS. 4A-4C illustrate a flow chart for a suitable program utilized by the microprocessor on the sure chip CU1 to implement the above manner of regulating coil holding current. When the loop is entered at 101, the regulator waits for an interrupt at the middle of positive half cycles as indicated at 103. On the first holding pulse as determined at 105 a seed value is selected at 107 for the delay in gating the positive voltage pulse to the FET CQ4. This seed value is selected such that sufficient current will be provided to the coil to hold the contactor closed whether or not there is an induced flux, and regardless of the phase of the induced flux relative to the control voltage. On subsequent executions of the loop, the regulator calculates the pulse delay required to regulate the holding current to the setpoint or target value as indicated at 109. When the delay is timed out at 111, the FETDRIVE signal is pulsed at 113 to turn on the FET CQ4 and gate the positive voltage pulse to the coil SC. The regulator then waits at 115 for transmits cause by the voltage pulse to settle before the coil current is read and stored as the "OLD" reading at 117. As indicated by the tag 'A' in FIGS. 4A and 4B, the regulator then waits for the zero crossing of the positive pulse at 119 to turn off the FET at 121.

The regulator then waits for an interrupt at the middle of the negative half cycle at 123 to set up the output delay for the rectified negative voltage pulse at 125. When this delay has expired at 127, the output pulse turning on the FET CQ4 to gate the appropriate portion of the negative pulse is generated at 129. The zero crossing following the negative half cycle of the control voltage is detected at 131, however, the FET is not turned off at this point as in the case of the positive half cycle. As indicated by the tag 'B' linking FIGS. 4B and 4C a delay is initiated at 133 to establish ac current again, and then the second coil current reading is taken during the beginning of the positive half cycle as indicated at 135. The offset is added to this measurement and stored as the "new" measurement at 137. The FET is then turned off at 139.

The "OLD" and "NEW" values of coil current are compared at 141. If the second, or "NEW," value is less than the "OLD" value, then the "NEW" measurement is stored as "FEEDBACK" in 143, otherwise the "OLD" measurement is stored as "FEEDBACK" in 145. The coil current feedback signal selected is then used to regulate the coil current by comparing the measured coil current, "FEEDBACK" to a target or setpoint value in 147. If the measured signal exceeds the target value, then the delay for turning on the FET is increased for the next cycle at 149. If the measured coil current is below the setpoint, the delay in gating the FET for the next cycle is decreased at 151. The program then loops back to the beginning on FIG. 4A as indicated by the tag 'C'.

If the regulator can read the coil current during both positive and negative half cycles of the control voltage, coil current measurements are taken during both the positive and negative half cycles of the control voltage as shown in FIGS. 5A-5D at points C and D, respectively. These current readings are taken at a selected delay interval after the respective positive and negative pulse has been gated to the coil. Thus, the two current readings are taken substantially 180 electrical degrees apart, and therefore, no offset need be applied to the negative readings since under steady state conditions and no induced flux the two measured values of coil current should be substantially the same.

Figure 6A:
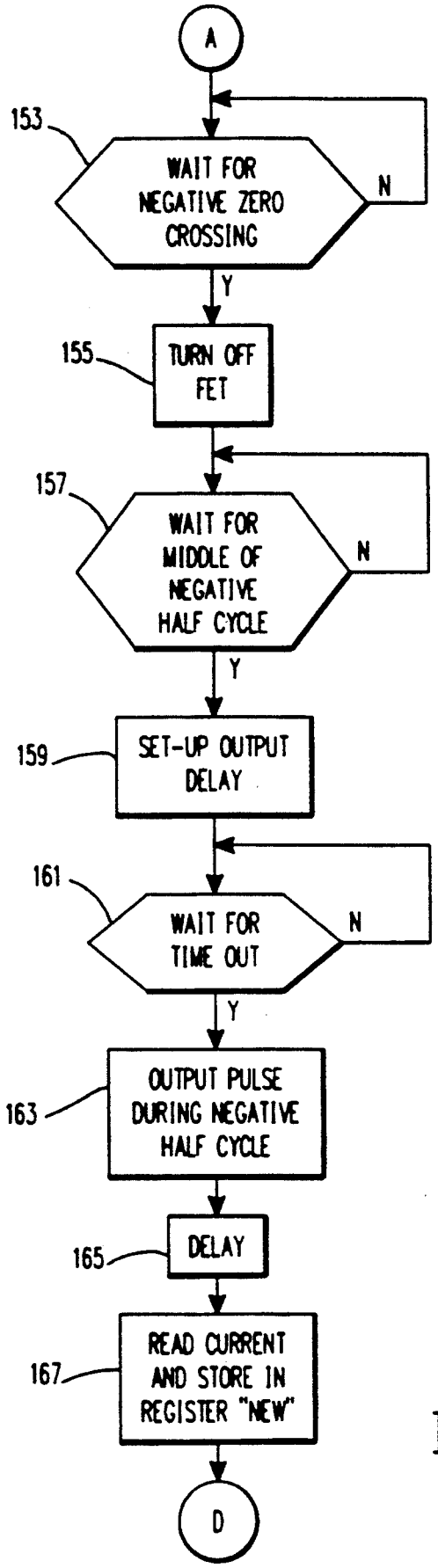
FIGS. 6A and 6B are flow charts of a suitable program for operating the microprocessor in accordance with the operation of the invention as illustrated in FIGS. 5A-5D.

A flow chart for a suitable computer program for implementing this embodiment of the invention follows the initial portion of the flow chart illustrated in FIG. 4A. The flow chart for this embodiment of the invention picks up from the tag "A" in FIG. 4A with the tag "A" on FIG. 6A. As in the case of the first embodiment of the invention, after the reading of coil current during the positive half cycle is taken at 117 in FIG. 4A, the program waits for the negative zero crossing at 153 to turn off the FET at 155.

Figure 6B:
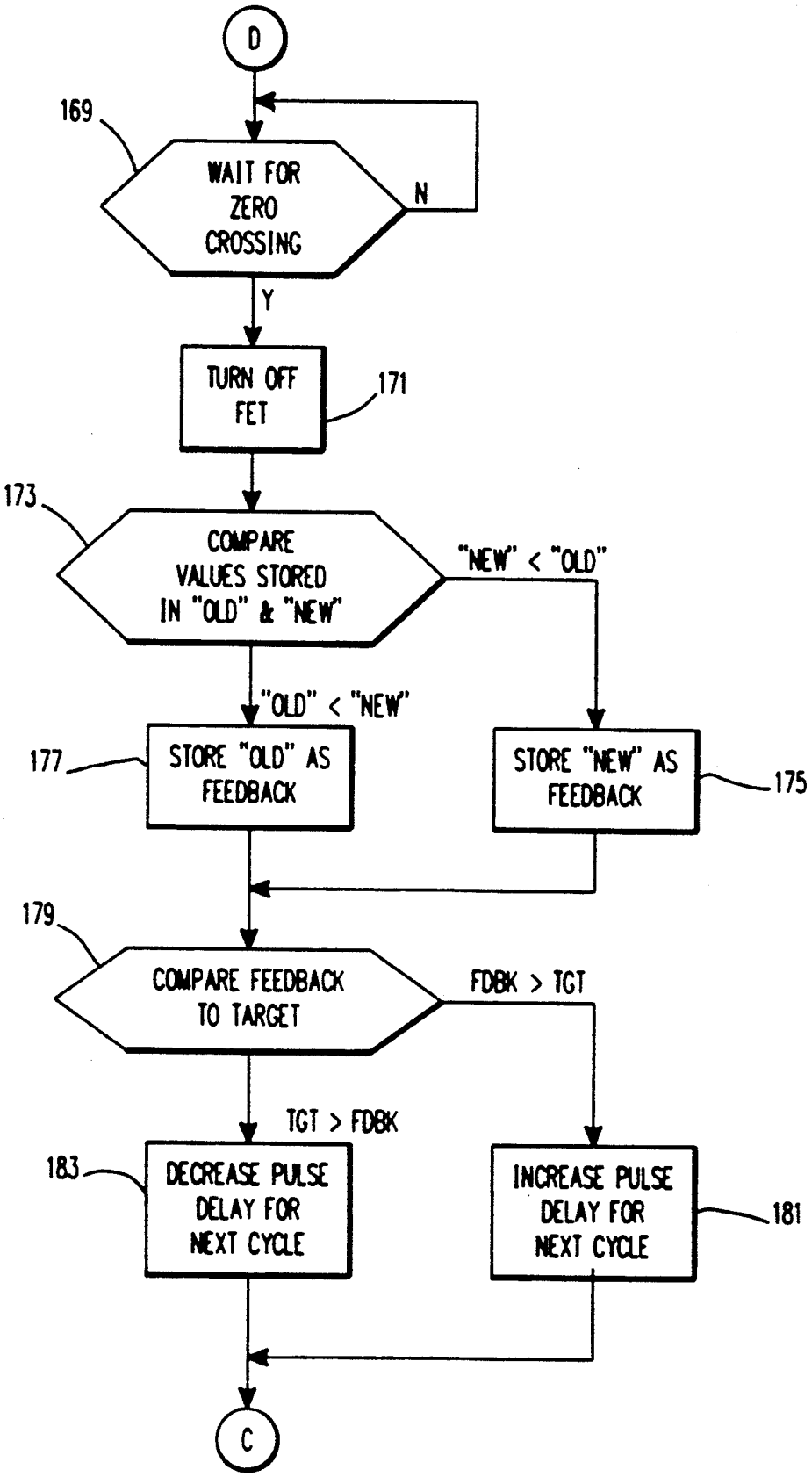

The program then waits for the interrupt generated at the middle of the negative half cycle at 157 and sets up the delay for gating the rectified negative half cycle pulse at 159. When the delay times out at 161, the FET is turned on at 163 to gate the rectified negative half cycle pulse to the coil. The program then waits at 165 for the transient caused by the voltage pulse to settle and takes a reading of the current at 165 for storage as the "NEW" measurement of coil current. As shown by the tags "D" in FIGS. 6A and 6B, the program waits for the zero crossing at 169 indicating the rectified negative half cycle pulse and turns off the FET at 171. As in the case of FIG. 4C, the smaller reading of coil current is selected as the "FEEDBACK" signal in blocks 173, 175 and 177, and compared at 179 with the setpoint target to either increase or decrease the pulse delay on the next cycle as indicated at blocks 181 and 183 before the program loop back to the beginning as indicated by the tag "C".

By compensating for induced flux caused by the load current flowing through the main contacts of the contactor, the invention assures that the contactor will remain closed despite induced flux caused by load currents up to 15 times rated current with a minimum power consumption and resultant heating of the contactor.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An electrical contactor having separable contacts, an electromagnet coil controlling opening and closing of said separable contacts to control a flow of load current therethrough, coil energizing means gating pulses of full wave rectified ac voltage to said electromagnet coil to close said separable contacts, and regulating means delaying gating of said pulses of full wave rectified ac voltage to said electromagnet coil to regulate coil holding current maintaining said separable contacts closed, and including means adjusting regulation of said coil holding current to compensate for flux induced in said coil by said load current.

2. The electrical contactor of claim 1 wherein said regulating means includes measuring means taking two measurements of coil holding current at two spaced apart instants during each cycle of ac voltage and wherein said regulating means selects a smaller of the two measurements for regulating coil holding current.

3. The electrical contactor of claim 2 wherein said measuring means makes a first measurement of coil holding current at an instant during a positive half of a cycle of said ac voltage and makes a second measurement of coil holding current at an instant during a negative half of said cycle of ac power.

4. The electrical contactor of claim 3 wherein said measuring means makes said first measurement of coil holding current during said positive half cycle of ac voltage after gating of a positive half cycle pulse of rectified ac voltage to said electromagnet coil, and makes said second measurement of coil holding current during said negative half cycle of ac voltage after gating of a negative half cycle pulse of rectified ac voltage to said electromagnet coil.

5. The electrical contactor of claim 4 wherein said first and second measurements are made about 180 electrical degrees apart.

6. The electrical contactor of claim 4 wherein said first measurement of coil holding current is made a first delay period after gating of said positive half cycle pulse of rectified ac voltage to said electromagnet coil and said second measurement of coil holding current is made a second delay period after initiation of gating of said negative half cycle pulse of rectified ac voltage to said electromagnet coil.

7. The electrical contactor of claim 6 wherein said first and second periods are substantially equal in duration.

8. The electrical contactor of claim 2 wherein said coil energizing means includes electronic switch means, and wherein said regulating means includes means turning on said electronic switch means to gate pulses of rectified ac voltage to said electromagnet coil and means turning off said electronic switch means after a pulse of a positive half cycle of rectified ac voltage and delaying turning off of said electronic switch means after a pulse of negative half cycle of rectified ac voltage until after a beginning of a following positive half cycle of ac voltage, and wherein said measuring means makes said first measurement of coil holding current during said positive half cycle of rectified ac voltage after said electronic switch means is turned on to gate said pulse of positive half cycle rectified ac voltage to said holding coil, and makes said second measurement of coil holding current during said beginning of said following positive half cycle of rectified ac voltage after said pulse of said negative half cycle of rectified ac voltage and before said electronic switch means is turned off.

9. The electrical contactor of claim 8 wherein said regulating means includes means compensating said second measurement for a difference in phase of said ac voltage at said first and second measurements.

10. The electrical contactor of claim 9 wherein said measuring means comprises means measuring ac current flow to said coil energizing means.

11. A method of operating an electrical contactor having separable contacts and an electromagnet controlling opening and closing of said separable contacts to switch a flow of load current therethrough, said method comprising the steps of:

gating pulses of rectified ac voltage to a coil of said electromagnet to close said separable contacts;

regulating holding current in said coil once said separable contacts are closed by selectively delaying gating of said pulses of rectified ac voltage to said coil, and adjusting said regulating holding current to compensate for flux induced in said coil by said load current.

12. The method of claim 11 wherein said step of adjusting includes making two measurements of said holding current at spaced apart instants during a cycle of ac voltage and selecting a smaller of said two measurements for regulating holding current.

13. The method of claim 12 wherein one of said measurements of holding current is made during a positive half of a cycle of said ac voltage and another is made during a negative half of the cycle.

14. The method of claim 13 wherein said measurements of holding current are made after gating said pulses of rectified ac voltage to said coil.

15. The method of claim 14 wherein said one measurement of holding current is made a preselected first delay interval after a rectified pulse of said positive half cycle of ac voltage is gated to said coil, and said another measurement is made a predetermined second delay interval after said rectified pulse of said negative half cycle of ac voltage is gated to said coil, said predetermined second delay interval being substantially equal to said predetermined first delay interval.

16. The method of claim 12 wherein said two measurements of holding current are made by measuring positive values of ac current supplied to said coil, wherein said rectified ac voltage is gated to said coil by turning on an electronic switch with said selective delay after a beginning of a positive half cycle of said voltage and turning said electronic switch off at the end of said positive half cycle and turning on said electronic switch with said selective delay after a beginning of a negative half cycle of said ac voltage and turning said electronic switch off after the beginning of a following positive half cycle of said ac voltage, and wherein one of said two measurements of said ac current is made during said positive half cycle of ac voltage after said positive pulse is gated to said coil, and the other of said two measurements of said ac current is made during said beginning of the positive half cycle of ac voltage before said electronic switch is turned off after gating a rectified pulse of the negative half cycle of ac voltage to said coil.

17. The method of claim 16 including adding a selected offset value to said other measurement to compensate for a difference in phase of said ac current at which said one and other measurements are made.

18. The method of claim 17 including setting said selected offset value by selecting a large initial offset value, regulating said holding current to the lesser of said one measurement of ac current and the other measurement of ac current plus said initial offset value with no load current through said separable contacts, monitoring said ac current, successively lowering said offset value from said initial offset value until the ac current as monitored begins to decrease, and selecting the offset value at the point where the ac current begins to decrease as the selected offset value.

* * * * *